United States Patent [19]

Sasaki et al.

[11] Patent Number: 4,539,953

[45] Date of Patent: Sep. 10, 1985

[54] APPARATUS FOR ACTUATING INTAKE AND EXHAUST VALVES IN INTERNAL COMBUSTION ENGINE

[75] Inventors: Yoshio Sasaki, Toyota; kazuyuki Saito, Okazaki, both of Japan

[73] Assignee: Toyota Jidosha Kabushiki Kaisha, Toyota, Japan

[21] Appl. No.: 659,869

[22] Filed: Oct. 12, 1984

Related U.S. Application Data

[63] Continuation of Ser. No. 460,021, Jan. 21, 1983, abandoned.

[30] Foreign Application Priority Data

Jan. 25, 1982 [JP] Japan ..... 57-8799

[51] Int. Cl.[3] ..... F01L 1/46

[52] U.S. Cl. ..... 123/90.41; 123/90.22

[58] Field of Search ..... 123/90.22, 90.41, 308, 123/432, 90.42, 90.46

[56] References Cited

U.S. PATENT DOCUMENTS

| | | | |
|---|---|---|---|
| 3,219,019 | 11/1965 | Palmer | 123/90 |
| 3,531,234 | 9/1970 | Ravenel | 123/90.41 X |
| 3,563,215 | 2/1971 | Ross | 123/90.42 |
| 3,712,278 | 1/1973 | Kuhn | 123/90.39 |
| 3,942,490 | 3/1976 | Scott | 123/90.4 |

FOREIGN PATENT DOCUMENTS

| | | |
|---|---|---|
| 875350 | 8/1961 | United Kingdom . |
| 963995 | 7/1964 | United Kingdom . |
| 1051107 | 12/1966 | United Kingdom . |
| 1198548 | 7/1970 | United Kingdom . |
| 1201214 | 8/1970 | United Kingdom . |
| 1437567 | 5/1976 | United Kingdom . |

*Primary Examiner*—William R. Cline
*Assistant Examiner*—Peggy A. Neils
*Attorney, Agent, or Firm*—Kenyon & Kenyon

[57] ABSTRACT

An apparatus for actuating valves consisting of a pair of main intake and exhaust valves and at least one auxiliary intake and/or exhaust valve, comprising cams on a single common cam shaft, for driving the associated valves, and rocker arms which can independently swing about fulcrum located in an alternate arrangement in an axial direction of the cam shaft, to transmit the movements of the cams to the associated valves so as to independently drive the valves.

1 Claim, 10 Drawing Figures

APPARATUS FOR ACTUATING INTAKE AND EXHAUST VALVES IN INTERNAL COMBUSTION ENGINE

This application is a continuation of application Ser. No. 460,021, filed Jan. 21, 1983, now abandoned.

BACKGROUND OF THE INVENTION

1. Field of the Invention

This invention generally relates to an internal combustion engine having an auxiliary intake or exhaust valve (or valves) in addition to main intake and exhaust valves for each cylinder, more particularly to an apparatus for actuating the valves.

2. Description of the Prior Art

Recently, multi-intake valve or multi-exhaust valve systems have been adopted in internal combustion engines for the purpose of increasing the engine output and decreasing the fuel consumption. In these systems, one (or two) auxiliary intake or exhaust valve is provided in addition to a pair of main intake and exhaust valves for each cylinder. A known means for actuating those valves is a twin cam shaft drive, wherein an auxiliary cam shaft is provided for the auxiliary value in addition to a cam shaft for the conventional main intake and exhaust valves. The provision of a twin cam shaft drive, however, not only means an increased number of cam shafts but also a more complex large and expensive drive. This is particularly serious in the case of an engine having a wedge-type combustion chamber, since there is not enough room to arrange the second cam shaft (auxiliary cam shaft). An improved drive mechanism of the valves has therefore been needed.

Alternatively, it has been known to actuate the valves by a single cam shaft. Such a known single cam shaft drive, however, needs two rocker arm shafts. Therefore, it also has the drawbacks of complexity, large size, and expensiveness of the valve drive, similar to the twin-cam shaft drive system.

SUMMARY OF THE INVENTION

The primary object of the present invention is, therefore, to eliminate the above-mentioned drawbacks by providing an apparatus, for actuating or driving a plurality of valves in an internal combustion engine, comprising a single cam shaft and no rocker arm shaft.

BRIEF DESCRIPTION OF THE DRAWINGS

The invention will be discussed below in detail with reference to the drawings showing preferred embodiments of the present invention; in which.

DESCRIPTION OF THE PREFERRED EMBODIMENTS

Figure 1:
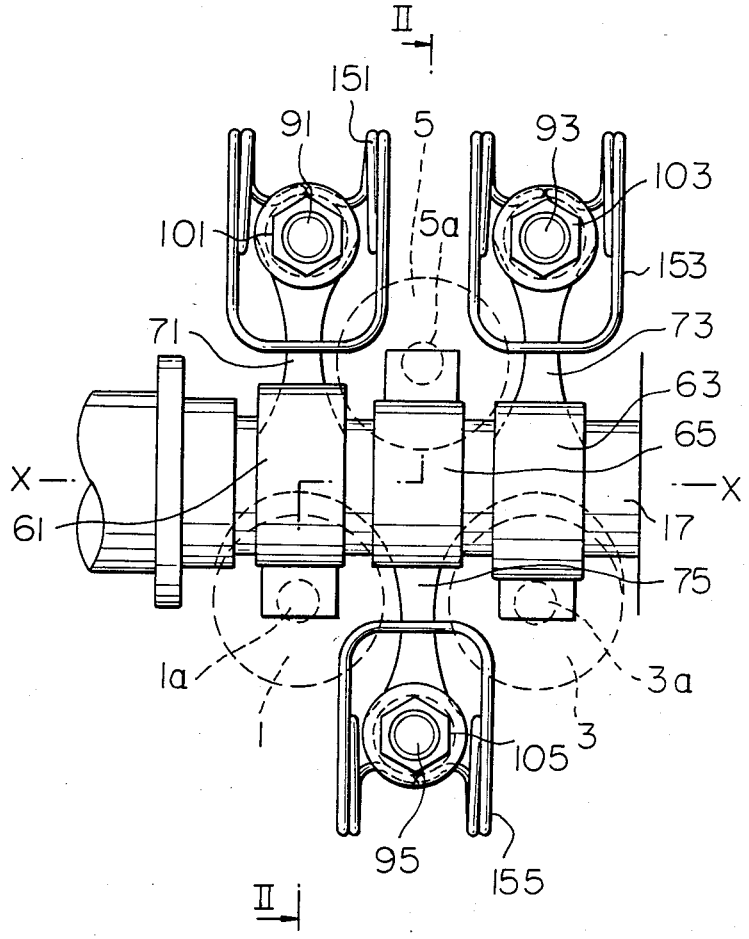
FIG. 1 is a plan view of an apparatus for actuating intake and exhaust valves according to the present invention.
Figure 2:
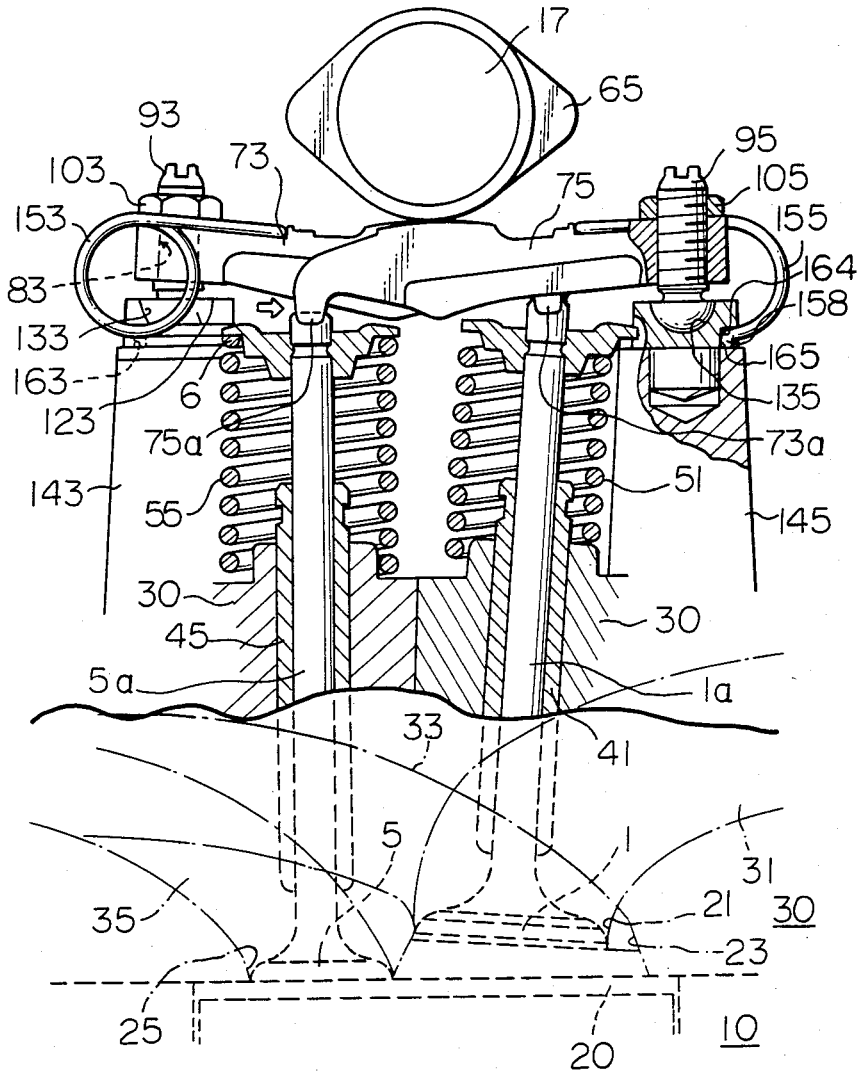
FIG. 2 is a sectional view taken along the line II—II in FIG. 1.

A main intake valve 1, auxiliary intake valve (third valve) 5, and main exhaust valve 3 are alternatively disposed on opposite sides of a cam shaft 17, i.e. a zigzag fashion viewed in a plane view, as shown in FIG. 1. These valves 1, 3, and 5 are located in main intake port 21, main exhaust port 23, and auxiliary intake port 25, respectively, as shown in FIG. 2, to open and close the associated ports. These ports 21, 23, and 25 open into a combustion chamber 20 defined in a cylinder 10 and are connected to a main intake passage 31, a main exhaust passage 33, and an auxiliary intake passage 35, respectively. The combustion chamber 20 may be of any shape, for example, a wedge shape or semishperical shape. Valve stems 1*a*, 3*a*, and 5*a* of the valves 1, 3 and 5 are slidably supported by respective stem guides 41, 45, etc., (stem guide for auxiliary valve 5 not shown) secured to a cylinder head 30. The valves 1, 3, and 5 are continuously biased toward their valve closed positions by respective return springs 51, 55, etc. (spring for auxiliary valve 5 not shown). The above-mentioned arrangement is a typical construction for an internal combustion engine having three valves.

Figure 3:
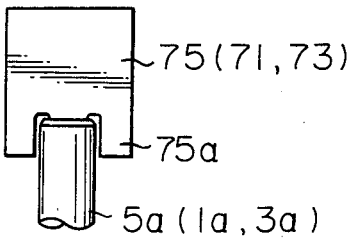
FIG. 3 is a partial view of a free end of the rocker arm viewed from the direction III in FIG. 2.

According to the present invention, cams 61, 63, and 65 for actuating the respective valves 1, 3 and 5 are secured to a common single cam shaft 17. The cams 61, 63, and 65 have cam profiles based upon predetermined valve timings of the respective valves 1, 3, and 5. According to the present invention, between the cams 61, 63, and 65 and the top ends of the valve stems of the associated valves 1, 3, and 5 are provided swing-type rocker arms 71, 73, and 75 adapted to transmit the movement of the cams to the respective valves. The rocker arms 71, 73, and 75 have bifurcated free ends 73*a*, 75*a*, (free end of valve stem 1*a* of main intake valve 1 not shown) in which the top ends of the associated valve stems are held so as not to come out of the bifurcated free ends, as shown in FIG. 3. The top ends of the valve stems 1*a*, 3*a*, 5*a*, are pushed down by the respective rocker arms 71, 73, and 75 against the respective return springs 51, 55, etc. to open the respective valve ports 21, 23 and 25. The rocker arms 71, 73, and 75 have pivots at their other ends for swing movement. That is, the rocker arms have, at the other ends opposite to the free ends, threaded holes (only threaded hole 83 of rocker arm 73 shown in FIG. 2), in which adjusting screws 91, 93, and 95 are screwed. The adjusting screws are secured to the respective rocker arms by means of locknuts 101, 103, and 105, so that the relative positions of the adjusting screws and the associated rocker arms can be adjusted to adjust tappet clearances of the rocker arms.

Figure 4:
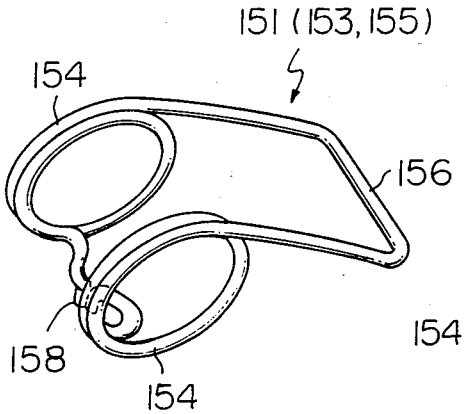
FIG. 4 is a perspective view of a keep spring shown in FIGS. 1 and 2.
Figure 5:
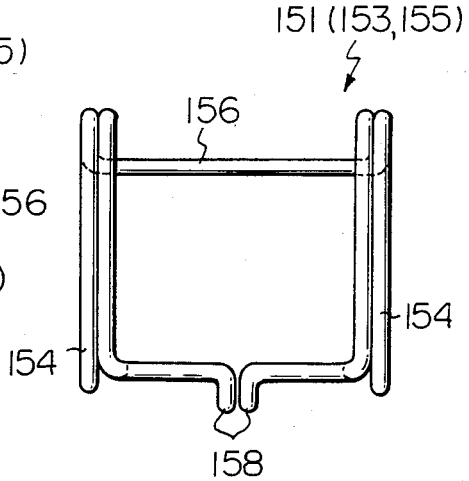
FIG. 5 is a front elevational view of FIG. 4.

The adjusting screws 91, 93, and 95 have generally semispherical lower ends (fulcrum for swing movement) 123, 125, lower end of adjusting screw 95 etc. (not shown) fitted in corresponding generally semispherical recesses 133, and 135 (only two recesses shown) provided in fulcrum bearing portions 143, 145 (only two bearing portions shown) integral with the cylinder head 30, for the independent swing movement of the rocker arms, respectively. The adjusting screws and, accordingly, the rocker arms tend to cause a universal motion or bound motion, because of the semi-spherical fulcrum (universal joint pivots). In order to prevent such a universal or bound motion, keep springs 151, 153, and 155, as shown in FIGS. 4 and 5 are attached to the rocker arms 71, 73, and 75, respectively.

Each of the keep springs has opposed coiled portions 154 and a straight abutment portion 156 which bears against the upper surface of the associated rocker arm 71 (73, 75) to push the rocker arm downward. The opposite ends of one keep spring 151 (153, 155) come together and are bent downward to form projections 158. The keep springs are of a symmetrical shape with respect to the projections 158. The end portions adjacent to projections 158 of each of the keep springs are fitted and held in corresponding peripheral grooves 164 formed in the bearing portions 143, 145, etc., and projections 158 are inserted into recesses 163, 165, etc. which are connected to the peripheral grooves (see partial cross section of bearing portion 145 in FIG. 2). The projections 158 can be welded to each other to prevent them from coming apart from each other. The rocker arms are thus continuously biased toward valve open positions of the associated valves by the keep springs. However, the spring force of the keep springs is smaller than that of the valve springs 51, 53, etc. and, accordingly, the keep springs are not strong enough to open the valves 1, 3, etc. against the valve springs which urge the associated valves into the valve closed position. Alternatively, the projections 158 can be dispensed with. Namely, it is not always necessary to bend the opposite ends of the springs downward.

According to the present invention, the fulcrums 123, 125, etc. of the rocker arms 73, 75, etc. are located on the opposite sides of an axis X—X of the cam shaft 17 in an alternate arrangement, i.e., in a zigzag fashion. The rocker arms 71, 73, and 75 are properly shaped so that they not only do not interfere with each other, but also do not interfere with the valve springs and the keep springs.

The valves 1, 3, and 5 are actuated by the respective cams 61, 63, and 65 secured to the common cam shaft 17, in accordance with predetermined valve timings depending on the cam profiles of the cams. The movements of the cams are transmitted to the associated valves by means of the swing-type rocker arms in an alternate arrangement.

Figure 6:
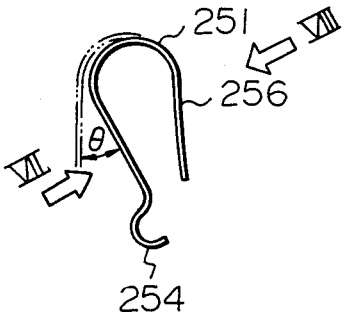
FIG. 6 shows a variant of a keep spring according to the present invention.
Figure 7:
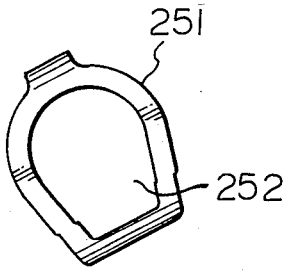
FIG. 7 is a view from an arrow VII in FIG. 6.
Figure 8:
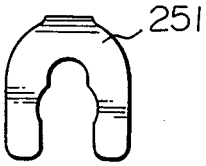
FIG. 8 is a view from an arrow VIII in FIG. 6.

FIGS. 6 to 8 show a variant of the keep spring 151 (153, 155) shown in FIGS. 4 and 5. The keep spring which is composed of a coiled spring in FIGS. 4 and 5 is replaced by a bent leaf spring 251 (253, 255) in FIGS. 6 to 8. The leaf spring 251 (253, 255) has an opening 252 through which the associated adjusting screws 91, 93, etc. extend. The leaf spring 251 (253, 255) has a bent end 254 which can be attached to the associated rocker arm 71 (73, 75) so as to bias the rocker arm downward. The other end 256 of the leaf spring is connected to the associated fulcrum bearing portion 141 (143, 145).

Figure 10:
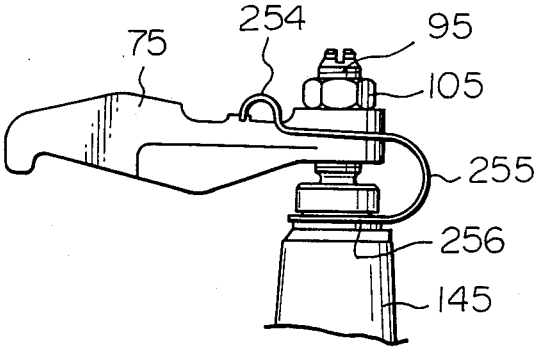
FIG. 10 is a partial view similar to FIG. 2 but showing an arrangement in which keep springs shown in FIGS. 6 to 8 are used.
Figure 9:
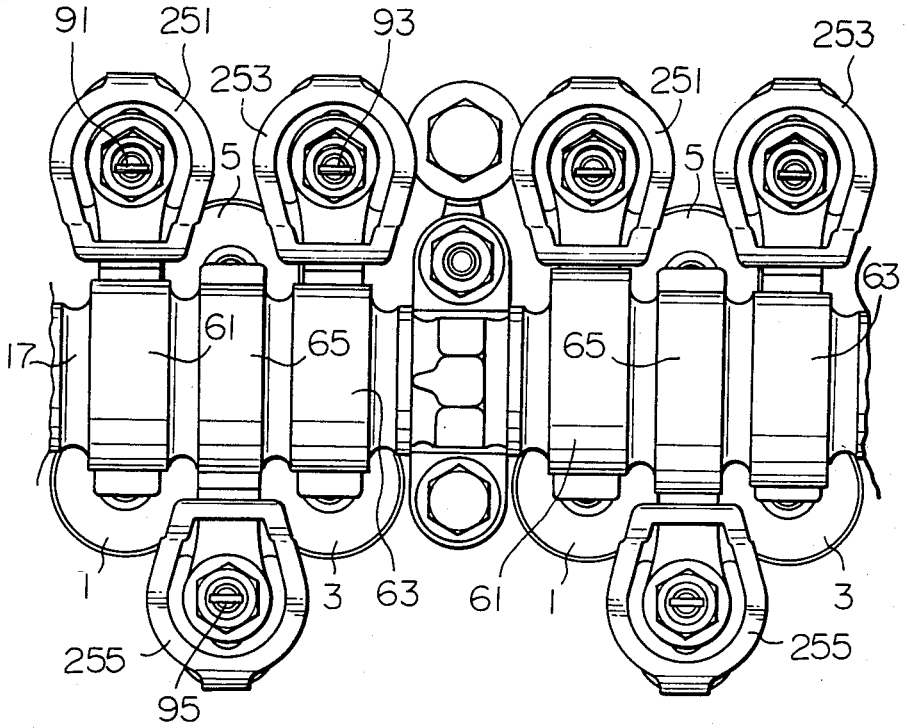
FIG. 9 is a view similar to FIG. 1 but showing an arrangement in which keep springs shown in FIGS. 6 to 8 are used.

FIGS. 9 and 10 show arrangements similar to FIGS. 1 and 2, respectively, in case of the use of leaf springs shown in FIGS. 6 to 8. It should be appreciated that the leaf spring can be easily manufactured and can have a larger spring force in comparison with the coiled spring as shown in FIGS. 4 and 5. The illustration of FIG. 9 is more practical in comparison with FIG. 1, but the operation of the modified arrangement shown in FIGS. 9 and 10 is quite the same as that of FIG. 1. Therefore, no detailed explanation for FIGS. 9 and 10 is given.

As can be understood from the above description, according to the present invention, since the intake and exhaust valves are actuated by the rocker arms which swing about the respective fulcrums located in an alternate arrangement and which are, in turn, actuated by a single common cam shaft, rocker arm shafts which would be otherwise necessary as in the prior art can be dispensed with, thus resulting in a simplified and inexpensive construction.

Finally, it should be noted that the number of the valves is not limited to three, that is, the number of the auxiliary valve is not limited to one. For example, an internal combustion engine having four valves, including one auxiliary intake valve and one auxiliary exhaust valve in addition to main intake and exhaust valves, for each cylinder is well known. The invention is, of course, applicable to such an internal combustion engine having four valves for each cylinder, wherein the four valves can be actuated by four swingable rocker arms arranged in a zigzag fashion in a way similar to the above mentioned embodiments directed to three valves.

We claim:

1. An internal combustion engine comprising a cylinder block containing a cylinder;

a cylinder head mounted on said block;

a main intake valve, a main exhaust valve, and at least one of an auxiliary intake valve and an auxiliary exhaust valve, said valves having stems extending through the cylinder head;

a single common camshaft mounted for rotation on the cylinder head over the cylinder, said valve stems being disposed on alternate sides of the camshaft in a direction parallel to the camshaft;

a separate universal joint support corresponding to each of said valves, each universal joint support being fixed to the cylinder head on the opposite side of the camshaft from the corresponding valve stem and including a socket at the upper end thereof;

a rocker arm for each valve, each rocker arm having one end pivotally mounted on the corresponding universal joint support and having an opposite end engageable with the stem of the corresponding valve;

a cam of said camshaft for each valve, each cam contacting the respective rocker arm intermediate the ends thereof for pivotally oscillating the rocker arm about the corresponding support;

means for preventing rotation of each rocker arm on said corresponding universal joint support out of contact with the corresponding valve stem, said means comprising said other end of each rocker being bifurcated to extend closely along opposite sides of the free end of the valve stem;

means for continuously biasing each rocker arm into contact with the free end of the associated valve stem, said biasing means comprising a keeper leaf spring formed from sheet spring stock, said leaf spring having an open U-shaped portion comprising a first curved section joining first and second arms having spaced apart outer free ends, a closed U-shaped portion comprising a second curved section joining third and fourth arms having spaced apart outer ends and a cross member joining the outer ends of the third and fourth arms, and an intermediate portion joining the first and second curved sections of the respective open and closed U-shaped portions, said intermediate portion being bent so that the outer ends of the first and second arms of the open U-shaped portion extend toward the ends of the third and fourth arms of the closed U-shaped portion in the unstressed condition, the first and second arms of the open U-shaped portion being engaged in a slot on said universal joint support, and the cross member of the closed U-shaped portion engaging and being stressed to bear downward on the top of the rocker arm at a location spaced from the pivot point at the one end of the rocker arm toward the other end thereof; and means for adjusting the rocker arm clearance, said adjusting means comprising an adjusting screw mounted in a threaded hole in the one end of the rocker arm, the adjusting screw having a ball head at one end engaging said socket in the corresponding universal joint support and a single cross-slot at the other end, and a locknut screwed on the other end of the adjusting screw and bearing against the top of the rocker arm, wherein said closed U-shaped portion of the keeper leaf spring extends around the one end of the rocker arm below the level of the locknut, whereby the keeper leaf spring does not interfere with lash adjustment of the rocker arm.

* * * * *